United States Patent [19]

Huska

[11] Patent Number: 4,832,628

[45] Date of Patent: May 23, 1989

[54] TERMINAL BLOCK INSERT DEVICE

[76] Inventor: Paul Huska, 739 Moreno Ave., Los Angeles, Calif. 90049

[21] Appl. No.: 194,537

[22] Filed: May 16, 1988

[51] Int. Cl.[4] ..... H01R 9/26; H01R 4/38

[52] U.S. Cl. ..... 439/716; 248/221.3; 439/728; 439/797; 439/812; 439/815; 439/817; 439/819; 439/838

[58] Field of Search ..... 439/709, 716, 796, 811, 439/812, 813, 819, 835, 838, 724, 727–729, 815, 817, 788; 248/221.3, 221.4, 231.2, 231.8, DIG. 6, 797, 798

[56] References Cited

U.S. PATENT DOCUMENTS

| | | | |
|---|---|---|---|
| 2,011,861 | 8/1935 | Knumann | 439/716 X |
| 3,246,283 | 4/1966 | Huska | 439/716 |
| 3,304,392 | 2/1967 | Isler | 439/817 X |
| 4,004,846 | 1/1977 | Woertz | 439/724 |
| 4,454,382 | 6/1984 | Borne et al. | 439/716 X |

*Primary Examiner*—Steven C. Bishop
*Attorney, Agent, or Firm*—Cislo & Thomas

[57] ABSTRACT

Improved terminal blocks having inserts comprising a spring-loaded stirrup for clamping electrical conductors, together with a screw for adjusting the clamping action of the stirrup and for releasably locking the stirrup in a fully open position to permit insertion of an electrical conductor, a mechanism for quickly and easily releasing the stirrup when the conductor is in a desired position, and an attachment member for releasably securing the block to a mounting rail.

27 Claims, 3 Drawing Sheets

TERMINAL BLOCK INSERT DEVICE

BACKGROUND OF THE INVENTION

This invention relates to terminal connection of electrical conductors and particularly directed to an insertable cage assembly device for use in connecting electrical conductors in a terminal block.

In the past, numerous devices have been proposed for securing electrical conductors in a terminal block. Clearly the most pertinent is U.S. Pat. No. 3,246,283, issued Apr. 12, 1966 to Paul Huska, the inventor in the present case. However, the '283 patent discloses a device wherein securing of the electrical conductor (or conductors) within the terminal block is dependent upon the craftsman turning a screw to open the terminal block to receive the conductor and, subsequently, reversing the screw to clamp the conductor end, while holding the conductor end in the desired position within the terminal block. The above is an over simplification of the work to be performed.

Terminal blocks are usually used to secure electrical or electronic conductors in communication systems, instrumentation systems and control systems from the simple to the most complex. It is obvious, therefore, that the highest degree of reliability be secured for conductor terminations. The integrity of any system is greatly contingent upon workmanship and adequacy of the terminal blocks.

Furthermore, mechanical motion, vibration, temperature variations, cold flow characteristics of materials used, realignment of conductor strands, especially where more than one conductor occupies the same "clamp space" affect proper connection. Under such conditions the reliability of the electrical/electronic systems noted above is of great concern. Indeed, life, property and equipment may be in jeopardy.

Moreover circuitry could be adversely affected due to changes in resistance values of a given circuit. Especially critical, is the problem of a conductor withdrawing from a terminal block because of the loosening actions described above. This occurs in many instances where conductors are installed under tension. Hence, when the force is great enough, a conductor will pull out and away from its terminal block. These kinds of occurrences, and they are frequent, can be disastrous. The present invention overcomes these problems and provides improved means for attaching the terminal block to a mounting rail.

A search in the U.S. Patent Office has revealed various others patents which are generally related to the present invention. The most pertinent patents found in the search are the following:

| Patent No. | Inventor | Issue Date |
|---|---|---|
| 1,439,657 | R. Zollner | Dec. 19, 1922 |
| 1,642,042 | J. L. Polk | Sept. 13, 1927 |
| 3,001,173 | A. H. Swengel | Sept. 19, 1961 |
| 2,166,346 | H. A. Douglas | July 18, 1939 |
| 3,152,855 | E. C. Crowther | Oct. 13, 1964 |
| 3,304,392 | E. W. Isler | Feb. 14, 1967 |
| 3,915,545 | Y. Saito | Oct. 28, 1975 |
| 3,989,345 | C. P. DeVito | Nov. 2, 1976 |
| 4,476,400 | T. Jo et al | Oct. 9, 1984 |
| 4,643,513 | C. B. Martin | Feb. 17, 1987 |

The Isler, Saito, Swengel, Martin and Zollner patents each suggests the use of spring clamping means. However, none of these provides a quickly releasable means for locking the clamping means in a fully open position to facilitate insertion of a conductor therein. The patents of Polk, Douglas, Crowther, DeVito and Jo are generally related to the subject matter of the present invention, but are believed to be less pertinent than those patents referred to above.

OBJECTS AND SUMMARY OF THE INVENTION

None of the prior art patents suggests a terminal block having a spring-loaded stirrup for clamping the conductor in place, together with a screw means for additional adjusting of the clamping action of the stirrup. Moreover, none of the references provide means for locking the stirrup in a fully open position to permit insertion of the conductor, yet allows the stirrup to be released, quickly and easily with a 90° turn, once the conductor or conductors are in the desired position.

Furthermore, the terminal block of the present invention provides improved means for releasably securing the terminal block to a mounting rail.

Accordingly, it is an object of the present invention to provide improved terminal blocks.

Another object of the present invention is to provide improved terminal blocks having inserts comprising spring-loaded stirrup means for clamping electrical conductors, together with screw means for adjusting the clamping action of the stirrup and for releasably locking the stirrup in a fully open position to permit insertion of an electrical conductor.

Another object of the present invention is to provide a terminal block connector which requires little or no screwing action to become fully opened or clamped to effectively preclude conductor loosening and which requires little space.

A further object of the present invention is to provide improved terminal blocks having inserts comprising spring-loaded stirrup means for clamping electrical conductors easily and positively, together with a screw means for further adjustment of the clamping action of the stirrup and for releasably locking the stirrup in a fully open position to permit insertion of an electrical conductor and means for quickly and easily releasing the stirrup when the conductor is in a desired position which can be visually determined.

An additional object of the present invention is to provide improved terminal blocks having means for releasably securing said block to a mounting rail.

Another object of the present invention is to provide a terminal block connector with a screw that cannot be lost, but instead held captive.

Another object of the present invention is to provide a terminal block connector which will not deform even though heavy springs are used within to insure a strong clamping force.

A specific object of the present invention is to provide improved terminal blocks having inserts comprising spring-loaded stirrup means for clamping electrical conductors, together with screw means for adjusting the clamping action of the stirrup and for releasably locking the stirrup in a fully open position to permit insertion of an electrical conductor and means for quickly and easily releasing the stirrup when the conductor is in a desired position, and attaching means for releasably securing the block to a mounting rail.

These and other objects and features of the present invention will be apparent from the following detailed description taken with reference to the figures of the accompanying drawing.

DETAILED DESCRIPTION OF THE INVENTION

Figure 1:
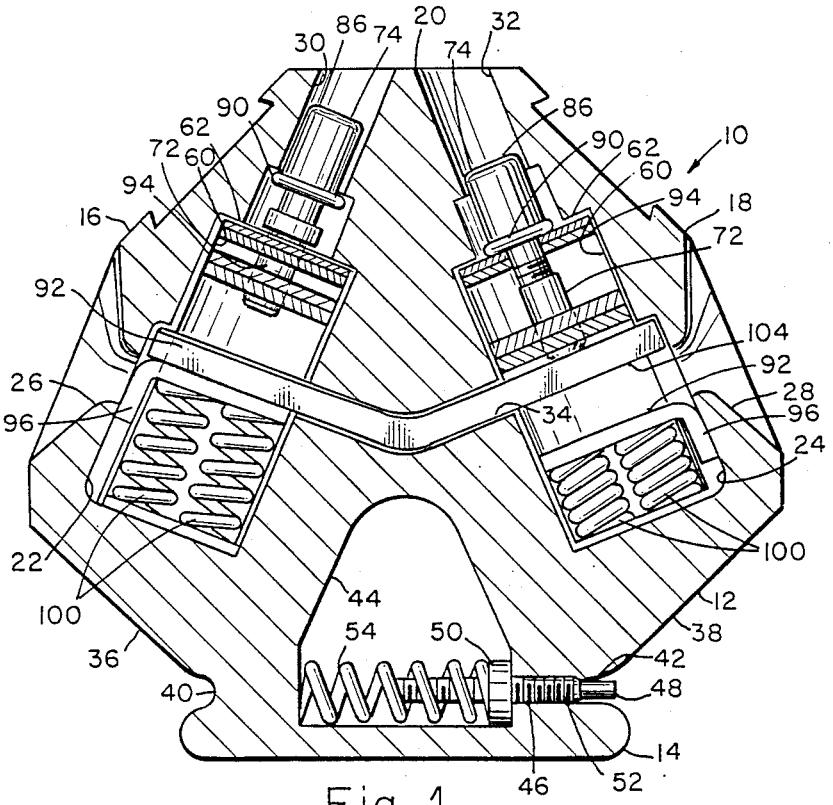
FIG. 1 is a front elevation of the terminal block of the present invention shown with the front wall of the cage removed for clarity.

In that form of the present invention chosen for purposes of illustration in the drawings, FIG. 1 shows a terminal block, indicated generally at 10, having a body 12 which is generally in the shape of a truncated triangle. Thus, the body 12 has a base 14 and a pair of converging sides 16 and 18 with a flattened top 20 that is somewhat smaller than the base 14. The body 12 may be formed of any suitable electrically insulating material. The body 12 has two generally rectangular recesses 22 and 24 formed therein and each of the recesses has its vertical axis extending generally parallel to the adjacent side 16 or 18 of the body 12. Each of the sides 16 and 18 is formed with an opening, as seen at 26 or 28, communicating with the adjacent side of a respective one of the recesses 22 and 24. Moreover, each of the recesses 22 and 24 is provided with an axial opening communicating with the top 20, as seen at 30 and 32. Also, a generally V-shaped recess 34 is formed in the body 12 and connects the recesses 22 and 24.

The lower portions of the sides 16 and incline inwardly to meet the base 14, as seen at 36 and 38 and form recesses 40 and 42 just above the base 14. A central opening 44 is formed in the body 12 between the recesses 40 and 42 and a lateral bore 46 communicates the central opening 44 with the recess 42.

As shown, a detent member 48 is slideably located in the bore 46 and is formed with a flange portion 50 which abuts the edge of the opening 44 adjacent the bore 46 and has a shaft portion 52 which projects through the bore 46 and extends some distance into the recess 42. A spring 54 is located within the opening 44 of the body 12 and serves to urge the detent member 48 into position.

Figure 13:
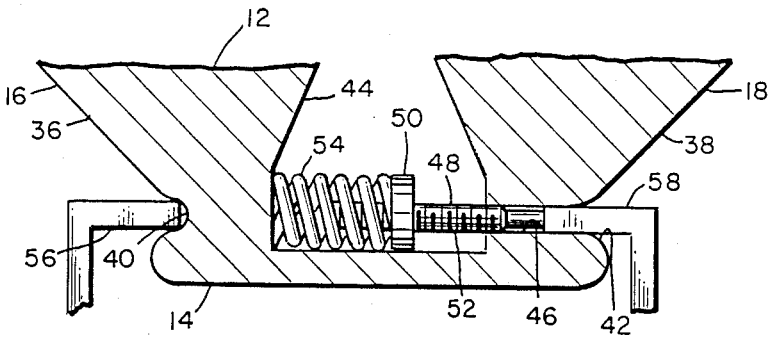
FIG. 13 is a view similar to that of FIG. 12 showing the base member fully secured to the mounting rail.
Figure 12:
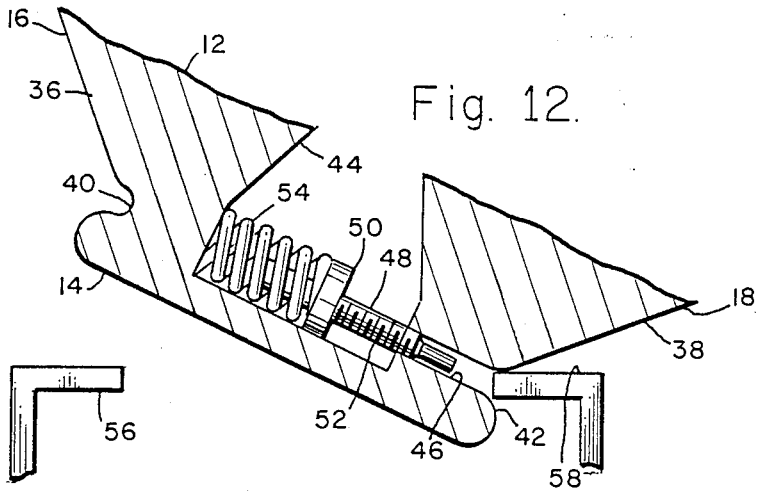
FIG. 12 is an enlarged detail showing the base member of the terminal block of FIG. 1 partially positioned on a mounting rail.

In use, the terminal block 12 is secured between a pair of opposed, spaced-apart flanges or rails, as seen at 56 and 58 in FIGS. 12 and 13. The flanges 56 and 58 may be supported by a generally U-shaped channel member, as shown in Applicant's earlier patent. However, the details of the support of the flanges 56 and 58 is not pertinent to the present invention. In order to secure the terminal block 12 to the flanges 56 and 58, the block 12 is tilted, as seen in FIG. 12 and the end of flange 58 is inserted into the recess 42 of block 12. As the end of the flange 58 is inserted into recess 42, it engages the outer end of detent 48 and forces the detent 48 to move inwardly along the bore 46 against the action of the spring 54.

When the flange 58 has been inserted sufficiently far into recess 42, the base 14 of the block 12 can be rotated to the position shown in FIG. 13, allowing the end of base 14 to clear the end of flange 56 and allowing the end of flange 56 to be inserted into recess 40. This permits some relaxation of the compression of spring 54. However, the spring 54 will still apply some pressure against detent 48 and will serve to effectively lock the terminal block 12 in position between the flanges 56 and 58. To remove the terminal block 12, the block is forced toward flange 58 against the action of the spring 54, causing the detent 48 to retract into the bore 46 and permitting the base 14 of the terminal block 12 to be rotated again to the position of FIG. 12 and, hence, to be removed from the flanges 56 and 58.

Figure 10:
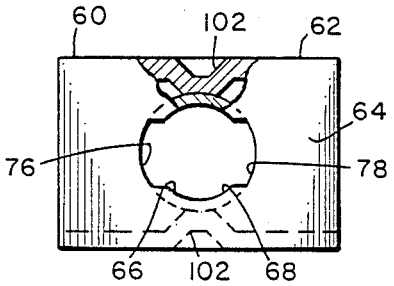
FIG. 10 is a top view of the cage of FIG. 8 with a portion of the side shown broken away for clarity.
Figure 8:
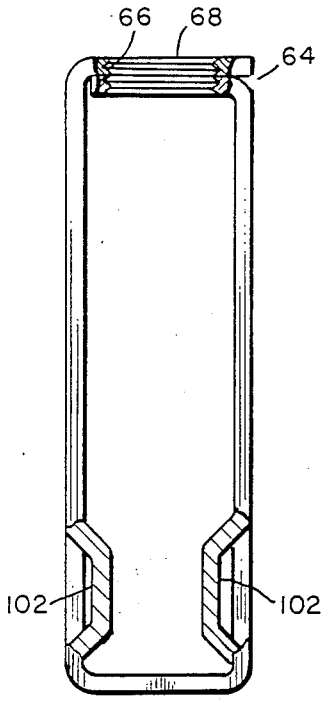
FIG. 8 is a side view of one of the cages of the terminal block of FIG. 1 with a portion of the top thereof shown broken away for clarity.
Figure 9:
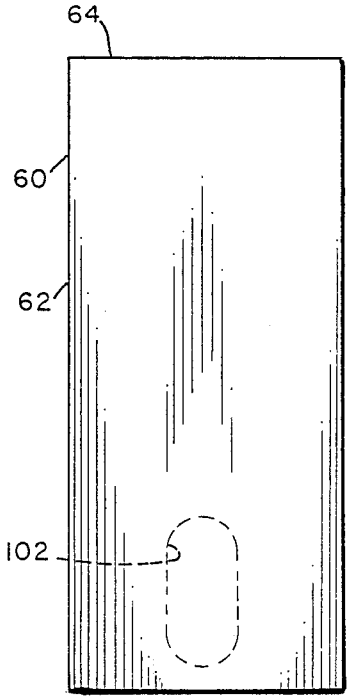
FIG. 9 is a front view of the cage of FIG. 8.

Turning now to a detailed description of the terminal block 12, each of the rectangular recesses 22 and 24 contains a clamping member, indicated generally at 60. The clamping members 60 are identical and each comprises a generally rectangular cage 62, as best seen in FIGS. 8, 9 and 10. As shown, each of the cages 62 is a generally rectangular, open-sided structure, preferably formed of relatively rigid material, such as metal, and may be extruded or formed of sheet metal which is lapped at the top to provide a thicker layer, as seen at 64. However, cages 62 may be of unitary construction without the sheet metal being lapped at the top.

Figure 5:
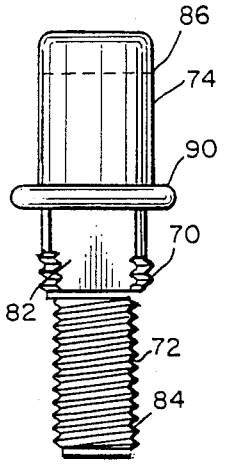
FIG. 5 is a side view of one of the adjusting screws of the terminal block of FIG. 1.
Figure 6:
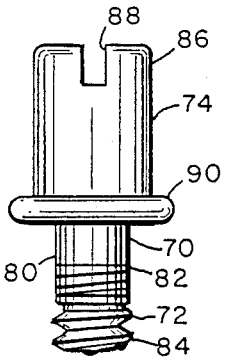
FIG. 6 is a front view of the upper portion of the adjusting screw of FIG. 5.
Figure 7:
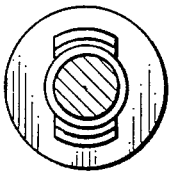
FIG. 7 is a bottom view of the screw of FIG. 5.

An axial bore 66 extends through the top 64 and is threaded (one or many threads), as seen at 68, to mate with the threaded inner diameter of the upper portion 70 of the shaft 72 of a screw member 74, as seen in FIGS. 5, 6 and 7. The threaded, inner diameter may have only a single thread sufficient to engage the screw. However, the bore 66 is formed with lateral extensions, as seen at 76 and 78, which eliminate the threads 68 in those areas. Correspondingly, the upper portion 70 of the screw 74 has flattened areas 80 and 82 formed on the sides thereof, as seen in FIGS. 5 and 6, which also eliminate the threads in those areas. The lower portion 84 of the shank 72 of screw 74 is of lesser diameter than the upper portion 70, as best seen in FIG. 5, and is threaded throughout the length thereof. The pitch of the threads of the upper portion 70 and lower portion 84 of the screw 74 are identical.

The diameter of the lower portion 84 of the screw 74 is such that the portion 84 of the screw 74 can pass freely through the bore 66 of the cage 62. In contrast, the upper portion 70 of the screw 74 will pass through the bore 66 only when the threaded portions thereof are aligned with the extensions 76 and 78 of the bore 66. When the screw 74 is rotated to cause the threads of the upper portion 70 to engage the thread or threads 68 of the cage 62, the screw 74, cage 62, and stirrup assembly will be locked and maintained in that position. If the portion 70 of screw 74 is pushed through the cage 62 and then rotated 90°, the screw-cage-stirrup assembly will be locked in that position. Above the upper portion 70, the screw 74 is provided with a head 86 which is dimensioned to project into one of the bores 30 or 32 and has a slot 88 formed in the upper surface thereof to permit rotation of the screw 74 by means of a conventional screwdriver, for example, not shown. A radially projecting flange 90 is provided o the screw 74 between the upper portion 70 and the head 86 and serves to engage the upper end of the recess 22 or 24 to limit upward movement of the screw 74.

Figure 3:
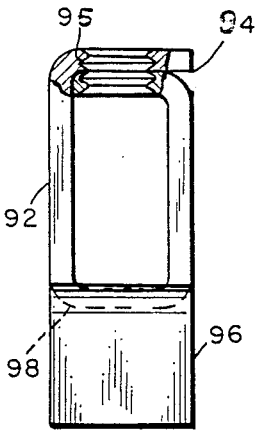
FIG. 3 is a front plan view of one of the stirrups of the terminal block of FIG. 1 with a portion shown broken away for clarity.
Figure 2:
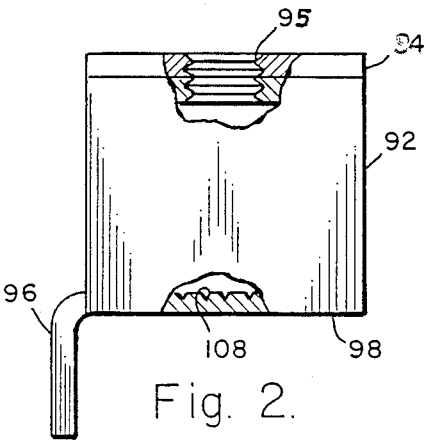
FIG. 2 is a side view of one of the stirrups of the terminal block of FIG. 1 with portions shown broken away for clarity.
Figure 4:
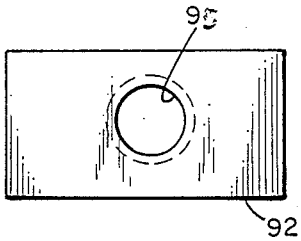
FIG. 4 is a top view of the stirrup of FIG. 2.

A generally rectangular, open-sided stirrup member 92, shown in FIGS. 2, 3 and 4, is slideably mounted within the cage 62, as seen in FIG. 1, and may be formed of rigid material, such as metal, which may be extruded or formed of sheet material which is overlapped at the top to provide a thickened area, as seen at 94 in FIGS. 2 and 3. The top 94 of the stirrup 92 is provided with a central bore 95 which is sized and threaded to mate with the lower portion 84 of the screw 74. In addition, the stirrup 92 is formed with a downwardly projecting flange 96 extending from the bottom 98 of the stirrup 92 on the side adjacent the respective one of the openings 26 or 28. As noted above, the stirrup 92 is slideably mounted within the cage 62 and a pair of springs 100 are positioned beneath the bottom 98 of the stirrup 92 and the inside bottom of the cage 62 to normally urge the stirrup 92 upwardly. The springs may be of a different number or type as shown herein, so long as the springs function similarly as the springs shown. If desired, indentations 102 may be provided generally centrally of the front and rear walls of the cage 62 adjacent the lower ends thereof, as seen in FIGS. 8 and 9, to retain the springs 100 in their proper positions and preclude interleafing of the springs 100.

Figure 11:
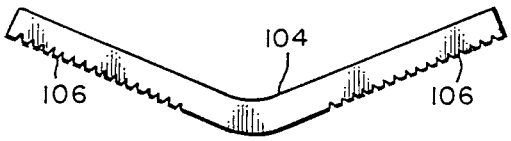
FIG. 11 is a front view of the bus bar of the terminal block of FIG. 1.

Finally, a generally V-shaped bus bar 104 is positioned in the recess 34 and extends through the recesses 22 and 24. The bus bar 104 is formed of electrically conductive material, such as copper, and, if desired may be formed with knurling grooves or points, as seen at 106 in FIG. 11, to improve or enhance electrical contact between the bus bar 104 and an electrical conductor clamped by the terminal block 12. The knurling helps to fracture possible layers of deleterious material on the conductor. Other conductive, but corrosive resistant materials may be used where corrosive environments are expected. Similarly, if desired, the inside of the bottom 98 of the stirrup 92 may be knurled, pointed or grooved for the same purpose, as seen at 108 in FIG. 2. It should be acknowledged by the person ordinarily skilled in the art that various configurations of knurling or indentation may be used to grip the conductor without damaging the conductor.

In use, the springs 100 will normally urge the stirrup 92 to the position shown in recess 22 on the left side of the terminal block 12 of FIG. I. In this position, the flange 96 of the stirrup will block the opening 26 and, hence, will prevent inadvertent admission of foreign objects into the interior of the terminal block 12 or the erroneous insertion of a conductor where lack of visibility of the block exists.

To clamp an electrical conductor into the terminal block 12, screw 74 must be rotated to a position such that the threads of the upper portion 70 are aligned with the extensions 76 and 78 of the bore 66 in the top 64 of the cage 62. The screw 74 is then pushed downward and, since the lower portion 84 of the screw 74 is mated with the threaded bore 95 in the top 94 of the stirrup 92, the stirrup 92 is moved against the action of the springs 100 to the position seen in recess 24 on the right side of the terminal block 12 of FIG. 1.

The screw 74 is then rotated to cause the threads of sheet metal cage 62 to thread into threads of the upper portion 70 of the screw 74 because the thickness or gage of sheet metal used is preferably complementary with the pitch of the threading of screw 74. However, as shown in the drawings, the upper portion 70 of the screw 74 engages the threads 68 of bore 66 in the top 64 of the cage 62 to lock the stirrup 92 in the open position. Moreover, the threaded portion 70 of screw 74 may be pushed completely through the top 64 of cage 62 at which time, by rotating screw 74, the stirrup assembly will be engaged to maintain an open position. Also, the screw 74 may be pushed completely through the top 64 of the cage 62. By pushing down on the screw 74 and rotating the screw 74, the top 94 of the stirrup 92 may be engaged to an open position. As seen on the right side of FIG. 1, this action permits the end of an electrical conductor or conductors, not shown, to be inserted through opening 24 into the space between the bottom of the bus bar 104 and the inside of the bottom 98 of the stirrup 92.

Thereafter, by simply rotating screw 74 to align the threads of the upper portion 70 of the screw 74 with the extensions 76 and 78 of the bore 66 in the top 64 of the cage 62, the springs 100 are released to urge the stirrup 92 upwardly, causing the conductor end to be clamped between the bus bar 104 and the inside bottom 98 of the stirrup 92. Clamping pressure on the conductors to be held can be increased, if desired, by further rotating the screw 74 in a direction forcing the stirrup 92 to be drawn towards the bus bar 104. The tension of this clamping action can be adjusted, if necessary, by rotating the screw 74 to cause the threads of the lower portion 84 to be driven into or out of the bore 95 in the top 94 of the stirrup 92. Different springs 100 having different tensions can be utilized to increase the clamping force on the conductor to prevent it from being pulled free.

To mount the terminal block 12 on a mounting rail, one of the flanges 58 of the mounting rail is inserted into the recess 42 between the side 18 and base 14 of the terminal block 12, as seen in FIG. 12, and serves to force the detent member 48 rearwardly in the bore 46 against the action of spring 54. The terminal block 12 is then rotated to a position shown in FIG. 13, where flange 56 of the mounting rail can engage recess 40 between side 16 and base 14 of the terminal block 12 and the pressure against detent 48 is relaxed. Thereafter, the action of spring 54 against detent 48 and, hence against flange 58 will serve to lock the terminal block 12 in position. To remove the terminal block 12, the block is forced toward flange 58 until flange 56 no longer engages recess 40 whereupon the terminal block 12 is rotated to the position seen in FIG. 12 and can be removed.

Obviously, numerous variations and modifications may be made to the terminal block without departing from the present invention. Therefore, it should be clearly understood that the form of the present invention described above and shown in the accompanying drawings is illustrative only and is not intended to limit the scope of the present invention.

I claim:

1. A terminal block comprising: a removable insert comprising spring-loaded stirrup means for clamping electrical conductors, together with screw means for adjusting the clamping action of said stirrup means and for releasably locking said stirrup means in a fully open position to permit insertion of an electrical conductor and for quickly and easily releasing said stirrup means to a closed position when said conductor is in a desired position, and attaching means for releasably securing said block to a mounting rail, said screw means having an upper portion and a lower portion with different geometries which allow quick and releasable locking of said stirrup means in said open or closed position.

2. The terminal block of claim 1 further comprising:

a body formed with at least one generally rectangular recess communicating with the front surface of said body, an opening formed in a side of said body communicating with said recess, and a generally vertical bore extending generally axially of said recess and communicating the top of said recesses with the top of said body.

3. The terminal block of claim 2 further comprising:

said body being of generally triangular configuration and having a pair of said recesses formed therein each extending generally parallel to an adjacent side of said body, a pair of said openings each communicating with a respective one of said recesses, and a pair of said bores each extending axially of a respective one of said recesses and communicating said one of said recesses with the top of said body.

4. The terminal block of claim 1 wherein said attaching means comprises:

a pair of recesses each connecting a respective side of said terminal block with the base thereof and extending the full width of said side and sized to receive a flange of said mounting rail, a central opening formed within said block, a lateral bore communicating said central opening with one of said recesses, a detent member located in said central opening having a portion projecting through said bore and into said one of said recesses and having a flange engaging the wall of said opening adjacent said bore, and resilient means urging said flange of said detent into engagement with said wall of said opening.

5. The terminal block of claim 2 wherein said insert comprises:

a generally rectangular, open-sided cage having a threaded opening formed in the top thereof and having lateral extensions of said opening eliminating the threads on the lateral sides of said opening;

a generally rectangular, open-sided stirrup slideably positioned within said cage and formed with a threaded opening in the top thereof of lesser diameter than said opening in the top of said cage;

a screw having a slotted head portion slideably insertable into the vertical bore of said body, said screw having an enlarged upper portion threaded to mate with the threads of said cage and formed with flattened side portions eliminating said threads and dimensioned to pass slideably through the opening in the top of said cage, a radially projecting flange formed between said head portion and said enlarged portion, and a lower threaded portion dimensioned to mate with the opening in the top of said stirrup; and resilient means located between the bottom of said stirrup and the bottom of said cage to urge said stirrup upwardly within said cage.

6. The terminal block of claim 5 wherein said insert further comprises:

said stirrup having a downwardly projecting flange extending from the bottom thereof on at least one side.

7. The terminal block of claim 5 wherein:

said cage and said stirrup are formed of rigid materials and the top portions thereof are formed thicker than the other portions thereof.

8. The device of claim 5 wherein said cage is formed of sheet materials lapped over at the top.

9. The device of claim 5 wherein said cage is formed of extruded material.

10. The device of claim 5 wherein said stirrup is formed of sheet material lapped over at the top.

11. The device of claim 2 wherein said body is formed of electrically insulating material.

12. A terminal block comprising:

a body of generally triangular configuration formed with a pair of generally rectangular recesses communicating with the front surface of said body and each extending generally parallel to an adjacent side of said body, a pair of openings each formed in a respective side of said body and communicating with the adjacent one of said recesses, and a pair of generally vertical bores each extending axially of a respective one of said recesses and communicating said one of said recesses with the top of said body;

insert means removably located in at least one of the recesses of said body, said insert comprising a generally rectangular, open-sided cage having a threaded opening formed in the top thereof and having lateral extensions of said opening eliminating the threads on the lateral sides of said opening;

a generally rectangular, open-sided stirrup slideably positioned within said cage and formed with a threaded opening in the top thereof of lesser diameter than the opening in the top of said cage, and having a downwardly projecting flange extending from the bottom thereof on at least one side;

a screw having a slotted head portion slideably insertable into the vertical bore of said body, said screw having an enlarged upper portion threaded to mate with the opening of said cage and formed with flattened side portions eliminating said threads and dimensioned to pass slideably through the opening in the top of said cage, a radially projecting flange formed between said head portion and said enlarged portion, and a lower threaded portion dimensioned to mate with the opening in the top of said stirrup; and resilient means located between the bottom of said stirrup and the bottom of said cage to urge said stirrup upwardly within said cage.

13. The terminal block of claim 12 wherein said attaching means comprises:

a pair of recesses each connecting a respective side of said terminal block with the base thereof and extending the full width of said side and sized to receive a flange of said mounting rail, a central opening formed within said block, a lateral bore communicating said central opening with one of said recesses, a detent member located in said central opening having a portion projecting through said bore and into said one of said recesses and having a flange engaging the wall of said opening adjacent said bore, and resilient means urging said flange of said detent into engagement with said wall of said opening.

14. The terminal block of claim 12 further comprising:

a generally V-shaped recess communicating between said rectangular recesses; and a generally V-shaped bus bar formed of electrically conductive material located in said V-shaped recess and extending through each of said recesses above the bottom of said stirrups.

15. The terminal block of claim 14, wherein said cage is made of sheet metal and of unitary construction having a continuous single thickness complementing said threads of said screw, thereby allowing said threads to engage said opening in said cage.

16. The terminal block of claim 15, wherein said opening in said cage has threading therein to engage said threads of said screw.

17. The terminal block of claim 14, wherein said cage comprising at least two thickness of sheet metal at a location of said opening of said cage for reinforcement.

18. A terminal block device for retaining electrical conductors comprising:

a biased stirrup means for clamping electrical conductors, a screw means for selectively engaging and disengaging said stirrup means causing said stirrup means to engage or disengage the electrical conductors over the range of a single rotation of said screw means, respectively, wherein said stirrup means is in a fully open or closed position dependent upon the selected orientation of said screw means.

19. A terminal block device as claimed in claim 18, further comprising a terminal block body, wherein said stirrup means is held within said terminal block body, said terminal block body holding said screw means, yet allowing exterior access thereto and allowing said screw means to actuate said stirrup means to said open or closed position by selective orientation of said screw means.

20. A terminal block device as claimed in claim 19, wherein said stirrup means includes a hole of a predetermined geometry to allow passage of a portion of said screw means therethrough when said screw means is selectively oriented with respect to said hole, wherein selective orientation of said screw means with said hole actuates said stirrup means to said open or closed position, respectively.

21. A terminal block comprising: a removable insert comprising spring-loaded stirrup means for clamping electrical conductors, together with screw means for adjusting the clamping action of said stirrup means and for releasably locking said stirrup means in a fully open position to permit insertion of an electrical conductor and for quickly and easily releasing said stirrup means when said conductor is in a desired position, and attaching means for releasably securing said block to a mounting rail, and further comprising:

a body formed with at least one generally rectangular recess communicating with the front surface of said body, an opening formed in a side of said body communicating with said recess, and a generally vertical bore extending generally axially of said recess and communicating the top of said recess with the top of said body; said body being of generally triangular configuration and having a pair of said recesses formed therein each extending generally parallel to an adjacent side of said body, a pair of said openings each communicating with a respective one of a respective one of said recesses and communicating said one of said recesses with the top of said body, wherein said attaching means comprises:

a pair of recesses each connecting a respective side of said terminal block with the base thereof and extending the full width of said size and sized to receive a flange of said mounting rail, a central opening formed within said block, a lateral bore communicating said central opening with one of said recesses, a detent member located in said central opening having a portion projecting through said bore and into said one of said recesses and having a flange engaging the wall of said opening adjacent said bore, and resilient means urging said flange of said detent into engagement with said wall of said opening.

22. The terminal block of claim 21 wherein said insert comprises:

a generally rectangular, open-sided cage having a threaded opening formed in the top thereof and having lateral extensions of said opening eliminating the threads on the lateral sides of said opening;

a generally rectangular, open-sided stirrup slideably positioned within said cage and formed with a threaded opening in the top thereof of lesser diameter than said opening in the top of said cage;

a screw having a slotted head portion slideably insertable into the vertical bore of said body, said screw having an enlarged upper portion threaded to mate with the threads of said cage and formed with flattened side portions eliminating said threads and dimensioned to pass slideably through the opening in the top of said cage, a radially projecting flange formed between said head portion and said enlarged portion, and a lower threaded portion dimensioned to mate with the opening in the top of said stirrup; and resilient means located between the bottom of said stirrup and the bottom of said cage to urge said stirrup upwardly within said cage.

23. The terminal block of claim 22 wherein said insert further comprises:

said stirrup having a downwardly projecting flange extending from the bottom thereof on at least one side.

24. The terminal block of claim 22 wherein:

said cage and said stirrup are formed of rigid materials and the top portions thereof are formed thicker than the other portions thereof.

25. The device of claim 22 wherein said cage is formed of sheet materials lapped over at the top.

26. The device of claim 22 wherein said cage is formed of extruded material.

27. The device of claim 22 wherein said stirrup is formed of sheet material lapped over at the top.

* * * * *